United States Patent [19]

Sandberg

[11] 4,278,365

[45] Jul. 14, 1981

[54] CONTROL SYSTEM FOR CONTROLLING A PLANT INCLUDING A MOBILE SUCTION DEVICE FOR SUCKING SUSPENDIBLE MATERIAL

[75] Inventor: Nils A. Sandberg, Hässleholm, Sweden

[73] Assignees: Ingenjorsfirman N. A. Sandberg Industrikonstruktioner AB; Trelleborg AB, both of Sweden

[21] Appl. No.: 891,275

[22] Filed: Mar. 29, 1978

[30] Foreign Application Priority Data

Mar. 31, 1977 [SE] Sweden ..... 7703749

[51] Int. Cl.[3] ..... B65G 53/66

[52] U.S. Cl. ..... 406/30; 37/58; 406/31; 406/113

[58] Field of Search ..... 302/34, 58; 37/58, DIG. 1; 406/30, 31, 113–115

[56] References Cited

U.S. PATENT DOCUMENTS

| | | | |
|---|---|---|---|
| 2,661,550 | 12/1953 | Graham | 37/58 |
| 3,224,121 | 12/1965 | Denning | 37/58 |
| 3,380,179 | 4/1968 | Schmidt | 37/58 |
| 3,690,731 | 9/1972 | Mylting | 302/58 |
| 4,037,335 | 7/1977 | Sandberg | 37/58 |
| 4,108,499 | 8/1978 | Sandberg | 302/34 |

FOREIGN PATENT DOCUMENTS

| | | | |
|---|---|---|---|
| 384452 | 5/1976 | Sweden | 37/DIG. 1 |

*Primary Examiner*—Jeffrey V. Nase
*Attorney, Agent, or Firm*—Blair, Brown & Kreten

[57] ABSTRACT

Method and apparatus for controlling sucking of a material suspendible in air or liquid by means of a suction nozzle connected to a pump through a conduit and having a flow rate or solids concentration sensor connected to said conduit, the suction nozzle being supported via a supporting wire rope or like flexible support by a hoisting device which is carried by a device for moving the hoisting device and the nozzle along at least one horizontal axis at adjustable velocity, while the nozzle is vertically adjustably carried by the hoisting device, wherein the hoisting device for vertically adjusting the nozzle is controlled with a control device by signals from the flow rate or solids concentration sensor in such a way that said flow rate or solids concentration sensor is preset to supply a control signal to the hoisting device for raising or lowering the nozzle to thereby restore the flow rate or solids concentration quantity per unit time in the conduit when the flow rate or solids concentration quantity per unit time exceeds or falls below a predetermined value which lies below a maximum value, and wherein the electric control circuit to which the flow rate or solids concentration sensor is connected, is adapted, when the flow rate or solids concentration quantity per unit time exceeds or falls below a certain upper and lower threshold level therefor and in dependence on said variations and on time and/or the working depth of the nozzle, to send the control signal from the flow rate or solids concentration sensor to a control valve, or alternatively, to the drive motor of the pump to increase or reduce the flow rate, by actuation of the valve or the pump, so that the control circuit thereby tends to maintain the flow rate and/or solids concentration quantity per unit time within definite limits.

5 Claims, 6 Drawing Figures

CONTROL SYSTEM FOR CONTROLLING A PLANT INCLUDING A MOBILE SUCTION DEVICE FOR SUCKING SUSPENDIBLE MATERIAL

BACKGROUND OF THE INVENTION

This invention relates to suction plants for sucking suspendible material by means of a suction nozzle movable along three relatively perpendicular axes, one of said axes being a vertical axis, while the other two axes lie in the horizontal plane. The invention more specifically concerns a development and improvement of a control system of the type covered by U.S. Pat. No. 4,037,335 and U.S. Pat. No. 4,108,499.

SUMMARY AND OBJECTS OF THE INVENTION

The invention has for its object to permit automatic control of suction plants of the kind referred to not only in dependence on the flow rate pumped per unit time but also, or alternatively, in dependence on the solids concentration of the flow and the resistance to the movements of the suction nozzle, which resistance may be due to the sludge concentration (or generally the solids concentration) or obstacles in the path of the nozzle.

A particular object of the invention is to exploit said control for regulation of the velocity of motion of a mobile nozzle supporting device and the working depth of the nozzle.

These and further objects, which will appear from the following specification, are realized by the provision of a method of controlling sucking of a material suspendible in air or liquid by means of a suction nozzle connected to a pump through a conduit and by means of a flow rate or solids concentration sensor connected to said conduit, the suction nozzle being supported via a supporting wire rope or like flexible supporting means by a hoisting device which is carried by a device for moving the hoisting device and the nozzle along at least one horizontal axis at adjustable velocity, while the nozzle is vertically adjustably carried by the hoisting device. The hoisting device for vertically adjusting the nozzle is controlled by means of a control device by signals from the flow rate or solids concentration sensor in such a way that said flow rate or solids concentration sensor is preset to supply a control signal to the hoisting device for raising and lowering the nozzle to thereby restore the flow rate or solids concentration quantity per unit time in the conduit when the flow rate or solids concentration quantity per unit time exceeds or falls below a predetermined value which lies below a maximum value. The electric control circuit to which the flow rate or solids concentration sensor is connected, is adapted, when the flow rate or solids concentration quantity per unit time exceeds or falls below a certain upper and lower threshold level therefor and in dependence on time or the working depth of the nozzle, to send the control signal from the flow rate or solids concentration sensor to a control valve, or alternatively, to the drive motor of the pump to increase or reduce the flow rate, by actuation of the valve or the pump, so that the control circuit thereby tends to maintain the flow rate and/or solids concentration quantity per unit time within definite limits.

Preferred embodiments of the invention present the following features.

Raising and lowering of the pump is also controlled by actuation of the hoisting device in dependence on the inclination of the flexible supporting means to the vertical, optionally in dependence on time.

The control circuit is switched from control of the working depth of the nozzle by regulation of the hoisting device to control by means of the pump or by means of the control valve, and vice versa, in dependence on both signal strength and time or in dependence on signal strength and certain nozzle depth sensed.

The flow rate or solids concentration sensor also controls the velocity of motion of said device for moving the hoisting device and the nozzle with regard to the flow rate or solids concentration quantity sensed, which is pumped through the conduit.

Said device for moving the hoisting device and the nozzle are controlled both with regard to start and stop and preferably also with regard to velocity by control signals from a device for sensing the height position or working depth of the nozzle.

The velocity of motion of said device for moving the hoisting device is controlled in dependence on the inclination of the flexible supporting means at definite limits of inclination angle and optionally in combination with time.

The pumped flow rate and/or solids concentration quantity is controlled in dependence on signals supplied by a device for sensing the weight load carried by the movable supporting means or the tension of said means.

The velocity of motion of the device for moving the hoisting device is also controlled in dependence on the position of said device in a definite path of movement.

The inclination of the wire rope relative to the vertical is sensed by means of a wire rope inclination sensor and the rpm of the pump motor is controlled in dependence on the wire rope inclination.

This invention also relates to an apparatus for practising the method of controlling sucking of a material suspendible in air or liquid, comprising a pump, a suction nozzle connected to said pump by a conduit with a flow rate or solids concentration sensor and carried via a supporting wire rope or like flexible supporting means by a hoisting device which in turn is carried by a device for moving the hoisting device and the nozzle along at least one horizontal axis at controllable velocity, while the nozzle is vertically adjustable by means of the hoisting device. In this apparatus a control circuit is connected to a signal transducer associated with the flow rate or solids concentration sensor and adapted to send to the control circuit signals proportional to the flow rate or solids concentration quantity, and the control circuit is adapted, when the flow rate or solids concentration quantity per unit time in the conduit exceeds or falls below predetermined, preferably presettable upper and lower limit values, to send in dependence on said variations and on time and/or the working depth of the nozzle control signals to a control valve and/or to the drive motor of the pump to control the flow rate by actuation of the control valve and/or the pump.

The invention will be described in greater detail hereinbelow with reference to the accompanying drawings in which:

BRIEF DESCRIPTION OF THE PREFERRED EMBODIMENT

Figure 1:
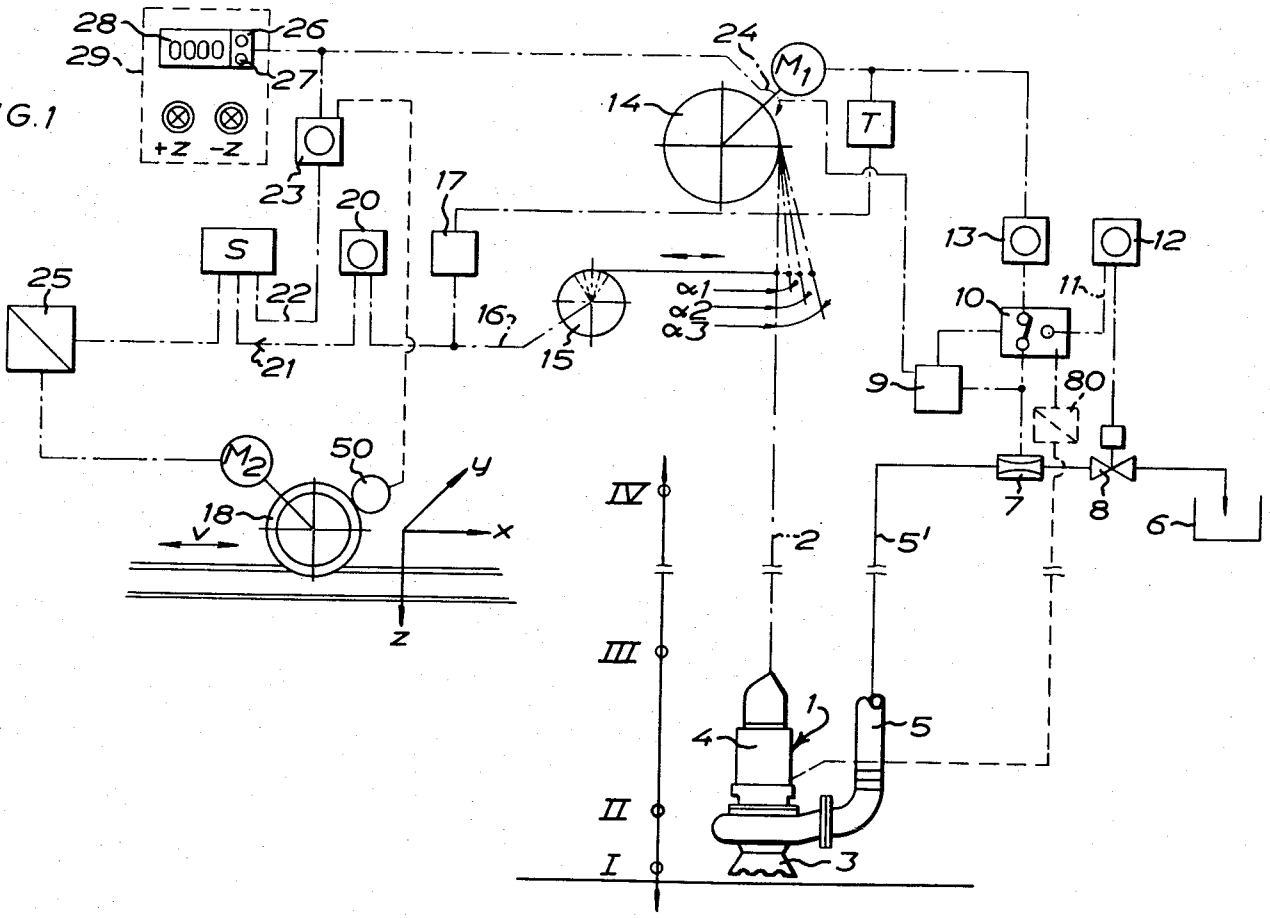
FIG. 1 is a schematic view of a control system according to the invention for controlling the movement of a suction assembly comprising a suction nozzle and a pump, said assembly being suspended in a top-running travelling crane by a flexible wire rope.

In FIG. 1 a suction assembly 1 comprising a suction nozzle 3 and a pump 4 is shown suspended in a wire rope 2. The suction side of the pump 4 is connected to the suction nozzle 3, while the pressure side of the pump is connected to an upwardly extending tube 5 in the form of a flexible pressure hose, only part of which is shown, but which extends along the full line 5' which symbolizes the continuation of the hose. The hose opens at a receiver 6 above the water surface of e.g. a sedimentation basin. A flow rate meter or a solids concentration sensor 7 with signal transducer, e.g. a magnetic flow rate meter or a so-called TS meter of a known type, and an electromagnetically operable control valve 8 are disposed in an upper part of the tube 5 which is symbolized by the full line 5'. The meter 7 has its electric signal output connected to a limit switch 9 and a switch 10 which can be set from the position illustrated into a position for connection with a control circuit 11 for controlling the valve 8 via a preferably presettable regulator 12. In the position shown in FIG. 1 the switch 10 is connected to a preferably presettable regulator 13 which in turn is connected to a time relay T (the function thereof will be described in the following) and to an electric motor $M_1$ for operation of a hoisting device 14 by means of which the assembly 1 can be raised and lowered via the wire rope 2 in dependence on signals sent to the regulator 13 from the meter 7.

The circle 15 in FIG. 1 symbolizes a wire rope angle sensor/signal transducer, preferably of the type indicated in U.S. Pat. No. 4,108,499, which senses the inclination of the wire rope 2 and sends electric control signals dependent thereon to a signal circuit 16. The time relay T is connected to the signal circuit 16 via an electronic limit switch 17 which is adapted via the time relay to actuate the hoist motor $M_1$ for positively raising the assembly 1 after an angular deflection, of certain duration, of the wire rope 2 over a predetermined value.

Prior to further description of FIG. 1 it should be mentioned that the hoisting device 14 is carried by a carriage (not shown) which is movable transversely of the travelling crane bridge structure on a hoist trolley movable longitudinally of said bridge structure. The bridge structure with the hoist trolley and the carriage thereon is shown only symbolically in the form of a drive wheel 18 and is movable longitudinally of the basin. U.S. Pat. No. 4,037,335 shows a travelling crane bridge structure with a trolley that can be utilized for carrying and moving the hoisting device 14 in two directions perpendicular to the horizontal plane. The height position of said assembly 1 is adjustable by means of said hoisting device 14.

There is further connected to the signal circuit 16 a preferably presettable regulator 20 for increasing or reducing the velocity of the bridge structure (bridge trolley) in dependence on the inclination of the wire rope 2. The signal output of the regulator 20 is connected to an input 21 of a selective selector S for coordination of control signals controlling the velocity of the bridge trolley. The selective selector S has a further input 22 which constitutes a signal input of a regulator 23 which, to permit increasing or reducing the velocity of the bridge trolley (see the following description) in dependence on the working level of the nozzle 3 and, indirectly, on the height of the sludge bed, is connected to a sensor 24 which is adapted to sense the length of the wire rope 2 paid out from the hoisting device 14 and thus, optionally in combination with the wire rope inclination sensed, the working level of the nozzle 3. The outgoing signal circuit of the selector S is connected, via a frequency converter 25 adapted to control the velocity of the bridge trolley, to an electric drive motor $M_2$ for the trolley drive wheel 18. The regulator 23 and the sensor 24 sensing the height position of the assembly 1 are connected via potentiometers (not shown), adjustable by means of knobs 26, 27, to a digital type height position meter 28 on a control panel generally designated 29 and comprising push buttons designated "+Z" and "−Z" for manual control of the bridge trolley via the regulator 23 automatically controlled by the sensor 24, and via the selector S and the frequency converter 25.

The control system described operates on the following two main principles.

Main Principle 1

Ordinarily, the pumped sludge flow decreases at increased sludge concentration which results in an increased resistance in conduit 5.

It if is assumed that the pump 4 pumps only water through the conduit 5, there is obtained through the meter 7 a maximum flow rate Q which is put equal to 100%. The regulator 13 can be preset so as to maintain e.g. a flow rate of 90% by control of the working depth of the assembly 1 via the hoisting device 14. If the flow rate Q, e.g. at the start, is 100% the meter 7 transmits a corresponding signal to the regulator 13 which compares the signal with a preset value corresponding to 90%, and the regulator 13 as a result brings about a lowering of the assembly 1 by actuation of the hoist motor $M_1$ to permit the nozzle 3 to work at the correct depth in the sludge bed for the flow rate of 90%. If the flow rate 90% of Q is not reached, this means that the nozzle works in too high a sludge concentration, and the regulator 13 then sends a regulating signal to the hoist motor $M_1$ for raising the suction assembly 1, which will reduce the sucked-in sludge concentration. In this way the working depth of the suction assembly 1 is thus automatically regulated by the regulator 13 for maintaining a flow rate of about 90% of Q.

If the flow rate exceeds 90% of Q, although the suction nozzle 3 of the assembly 1 is in a preset lowermost position, the limit switch 9 is actuated by a release signal from the depth sensor 24 via the regulator 13 and by the output signal from the signal transducer of the meter 7, thus causing the switch 10 to change over from flow control by means of the hoist motor (raising and lowering) to flow control by means of the control valve 8, whereby the control circuit can proceed with its continuous work also when the depth of the sludge bed has decreased by the sludge sucking operation to a value which does not any longer permit a 90% flow rate at normal valve setting, disturbances in the automatic control being thus avoided. Instead of activating the limit switch 9 by a signal from both 24 and 7 the limit switch can be activated by a signal only from 7 in that the limit switch can have a time relay function so that it causes changing over of the switch 10 when the flow exceeds 90% of Q by a certain amount for a certain adjusted time.

On a vertical line parallel with the wire rope 2 there is shown in FIG. 1 a depth graduation with four positions I, II, III and IV, for which the regulator 23 is actuated by the depth sensor 24. The regulator 23 is set at these positions and reacts to signals from the depth sensor 24. Said depth sensor can be an angle sensor actuated by the rope winch of the hoisting device 14, said sensor sensing the angular position of the winch and transmitting signals dependent on said position, the regulators reacting to the preset signal values corresponding to the selected positions I–IV. The lowermost position I indicates the lowest permissible pumping position, the second position II indicates a position for starting the travelling crane, the third position III indicates a stop of the travelling crane (which is automatically started and stopped by the regulator 23) and the uppermost position IV indicates the highest permissible pumping position. If the flow rate falls below 90% of Q, the control valve 8 is opened and if the flow rate falls below 90% of Q although the control valve 8 occupies fully open position the switch 10 is automatically changed over for that flow control which, like in the case first described, is caused by raising and lowering of the suction assembly 1 (the switch 10 is then again set into the position illustrated in FIG. 1).

When the suction assembly 1 on its upward movement passes position III on the height graduation, the sensor 24 shall, in the case assumed, give the regulator 23 the order to stop driving the bridge trolley, the regulator 23 breaking the current supply to the motor $M_2$. While the bridge trolley is at standstill, the suction assembly 1 again works down into the sludge because the flow meter 7 regulates the hoisting device 14 via the regulator 13. When the assembly 1 reaches position II on the height graduation, the motor of the bridge trolley is again started by an order signal from the sensor 24 to the regulator 23. The height sensor 24 can be preset for these positions, of which, however, positions I and IV can often be constant for actuation of the regulator 13, while positions II and III can be preset with the aid of the potentiometer knobs 26, 27 on the control panel.

Main Principle 2

Here, the control system is based on the fact that an increased sludge concentration tends to cause an increased lag of the assembly 1 in relation to the bridge trolley. Such a lag means an increase of the inclination of the wire rope 2, that is, the angular position thereof in relation to a vertical line drawn from the hoisting device 14.

When the suction assembly 1 hanging in its wire rope 2 is moved by means of the bridge trolley over the basin bottom 60 there arises because of water resistance a certain lag of the assembly, that is, the wire rope 2 makes a certain angular deflection in relation to the vertical. If the suction assembly 1 is now moved into a sludge bank, the angular deflection will increase. This angular deflection is sensed by means of the angle sensor/signal transducer 15 which, as already mentioned, can be of the embodiment described in U.S. Pat. No. 4,108,499. The angular deflection gives rise to a signal (current signal) proportional thereto in the signal circuit 16, said signal being sent via the regulator 20 and the selector S to the frequency converter 25 for regulation of the velocity of the bridge trolley. The travelling crane motor $M_2$ can be an electric motor which is infinitely variable between say velocity v=100% and 15% of the velocity v. The regulator 20 is preset in order to supply, when receiving a current signal transmitted by the angle sensor/signal transmitter 15 at a wire rope angle deflection of $\alpha 1$, the motor $M_2$ via the frequency converter 25 with a feed current corresponding to the velocity v=100%, that is, maximum velocity. With increasing angular deflections over $\alpha 1$ up to a given angular deflection $\alpha 2$ the signal current is increased from 15 and the speed of the motor $M_2$ is reduced to a minimum speed at the angle $\alpha 2$. The limit switch 17 is set for being changed over at a signal strength delivered by the angle sensor/signal transducer 15 at a given angle $\alpha 3$ which is greater than $\alpha 2$. When the angular deflection reaches and possibly exceeds $\alpha 3$, whereby the limit switch 17 is changed over, positive hoisting of the suction assembly 1 takes place. This positive hoisting is, however, timely predetermined with the aid of the time relay T. As mentioned under "Main Principle 1" the bridge trolley is stopped when the suction assembly 1 reaches position III on the height graduation, the vertical adjustment of the suction assembly 1 taking place with the aid of the automatic sludge sucking means until the suction assembly returns to position II on the height graduation, in which position the bridge trolley is again started. The position of the suction assembly on the height graduation thus contributes to the velocity regulation of the bridge trolley, but when the suction assembly 1 operates in the vicinity of position I on the height graduation (small depth of sludge bed) the velocity of the bridge trolley is controlled only by the angle sensor/signal transducer 15. If the suction assembly 1 is raised and operates in the vicinity of position III on the height graduation (but not above it), this means that the sludge bed has a peak and the bridge trolley is thus set for a lower velocity. The size of the minimum velocity can be determined by presetting of the regulator 23. The velocity of travel of the bridge trolley will thereby be directly proportional to the height of the sludge bed and the change in velocity of the bridge trolley directly proportional to the angular deflection of the wire rope 2.

It is readily seen that the size of the angular deflection of the wire rope 2 need not only be dependent upon the velocity of travel of the bridge trolley and the movement of the suction assembly 1 through a sludge bed, but also upon the length of the wire rope (working depth of the assembly 1) and, which is important to the control described hereinbelow, the weight of the suction assembly 1. The weight of said assembly can, if necessary, be increased or it may be made adjustable, which permits adjustment of the plant for the best possible operation under different conditions.

Figure 2:
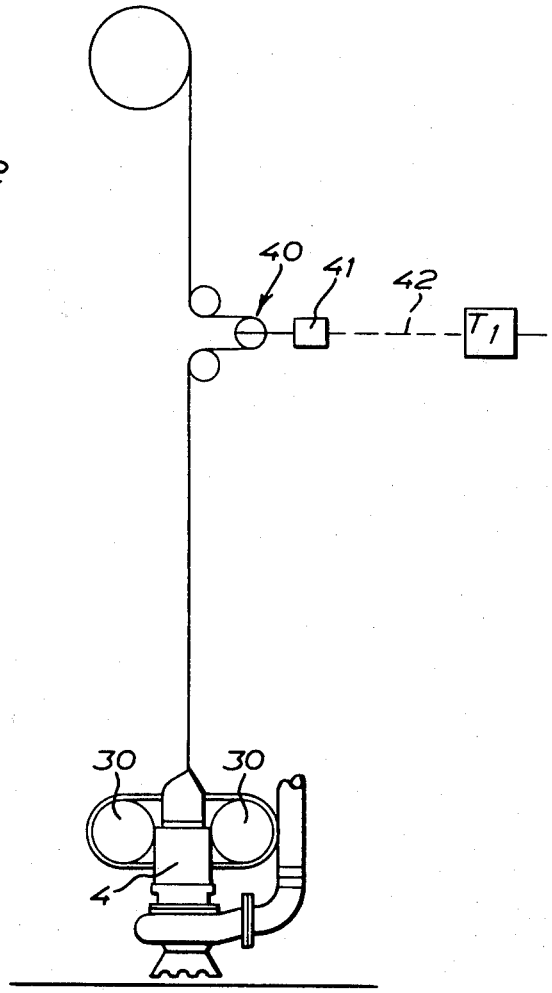
FIG. 2 shows a suction assembly with adjustable ballast and a wire rope including a weight or tension sensor which may be part of the control system shown in FIG. 1 and replace or supplement the wire rope inclination sensor.

FIG. 2 shows an example of an adjustable weight loading of the assembly 1. This device consists of a pair of ballast tanks 30, which can either be filled and emptied by the pump 4 or be connected by conduit means to a source of air disposed on the bridge trolley (this latter arrangement is not shown). By filling the tanks 30 with water the weight of the assembly 1 can be increased, and by blowing out the water by means of air the loading can be reduced. It should, however, be observed that the ballast tanks 30 are not necessary for describing the function of the device in FIG. 2.

As shown in FIG. 2, the wire rope 2 actuates a weight sensor 40. This sensor may be a weight sensor of any known type, e.g. a spring balance with electric signal transducer 41 which by means of a suitable switch (not shown) can be connected to the regulator 13 or the regulator 17 in FIG. 1. If the signal transducer is connected to the regulator 17 in FIG. 1, the hoist motor $M_1$ can be regulated both with regard to wire rope inclination and sensed weight at the wire rope.

When the suction assembly exerts a strong suction on the sludge bed, the pull at the wire rope increases, but when the weight of the nozzle rests on tough sludge or on the bottom, the pull at the wire rope decreases. A time relay $T_1$ can be provided in the electrical signal circuit 42. After a certain time a pulse is released to raise the pump to a definite level, if the pull at the wire rope at this time still is below a predetermined value, say 70% of the pull prevailing when the assembly 1 is freely carried in the wire rope at a certain depth. This control can be combined with the functions described for the control system in FIG. 1, for instance also in a manner such that the movements of the bridge trolley are influenced by control signals from the device 40.

Each time the hoisting device receives a lowering order from the control system in FIG. 1 the time relay $T_1$ receives a zero-setting pulse, but when the pump nozzle reaches the bottom and a lowering order does not realize lowering, the time relay is not restored, in which case the above control is carried out.

This device can be used also for controlling the bridge trolley in case the assembly 1 gets stuck and the load at the wire rope increases over a certain value. A control pulse can then be sent via the selector S or directly via the frequency converter 25 to the bridge trolley motor $M_2$ for stopping or even reversing the bridge trolley.

Control of the system for moving the bridge trolley at different velocities in dependence on the sludge profile (or generally the bottom profile), control of the height adjustment, switching of the control circuit between connected and disconnected valve 8 through the intermediary of the flow meter 7 can thus be combined with control effected by the wire rope angle sensor 15, the wire rope length sensor 24 and the weight sensor in FIG. 2.

It is also possible to vary the velocity of travel of the bridge trolley back and forth over a definite distance, such as in the case here described along a sedimentation basin, after a predetermined movement pattern.

Figure 3:
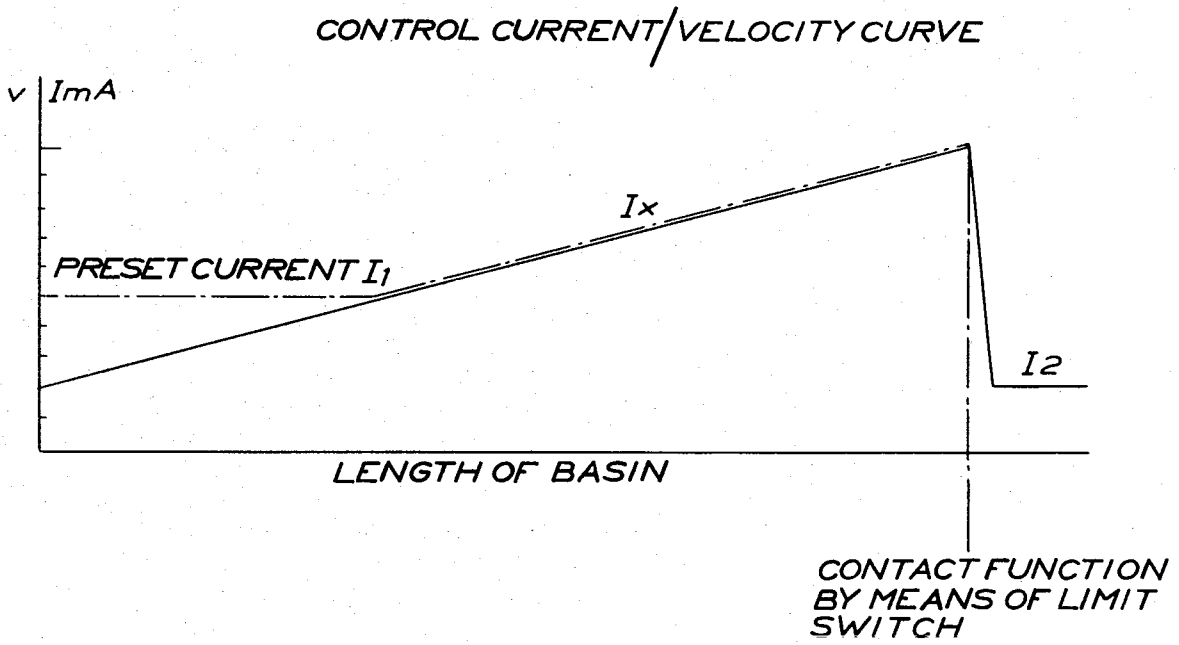
FIG. 3 is a diagram showing a possible variation curve for the velocity of travel of the bridge trolley of the travelling crane in a control system according to the invention.

A tachometer can be disposed on the drive wheel of the bridge trolley or any other wheel of the bridge trolley to sense parts of a wheel revolution, or use can be made of another instrument which can be arranged to sense the distance the bridge trolley moves along its path and give e.g. a full deflection for a distance of travel corresponding to the length L of the basin in FIG. 3, e.g. a deflection from Vo to Vmax. The instrument can be arranged to deliver a control signal of say between 4 and 20 mA for a deflection of between Vo and Vmax. Via a regulator, e.g. the regulator 23 in FIG. 1, and the frequency converter 25 this signal can regulate the velocity of travel proportionally to the current. The control current for the motor $M_2$ can be preset between 4 and 20 mA and the highest current can be allowed to determine the maximum velocity of travel. For instance, the length velocity diagram illustrated in FIG. 3 can be obtained by contact functions for the connection and disconnection of the frequency converter.

Such a tachometer is shown by way of example in FIG. 1 at 50 engaged with the hoist trolley wheel 18. The tachometer is connected to the frequency converter 25 via the regulator 23 and the selector S.

By this arrangement the bridge trolley can be given a certain velocity of travel for each given position longitudinally of the basin.

Use can be made of e.g. three currents $I_1$, $I_2$ and $I_x$, of which $I_1$ is a current adjustable between 4 and 20 mA, $I_2$ is a current adjustable between 4 and 20 mA, and $I_x$ is a variable current from the tachometer 50 and thus dependent upon the position of the bridge trolley.

Figure 4:
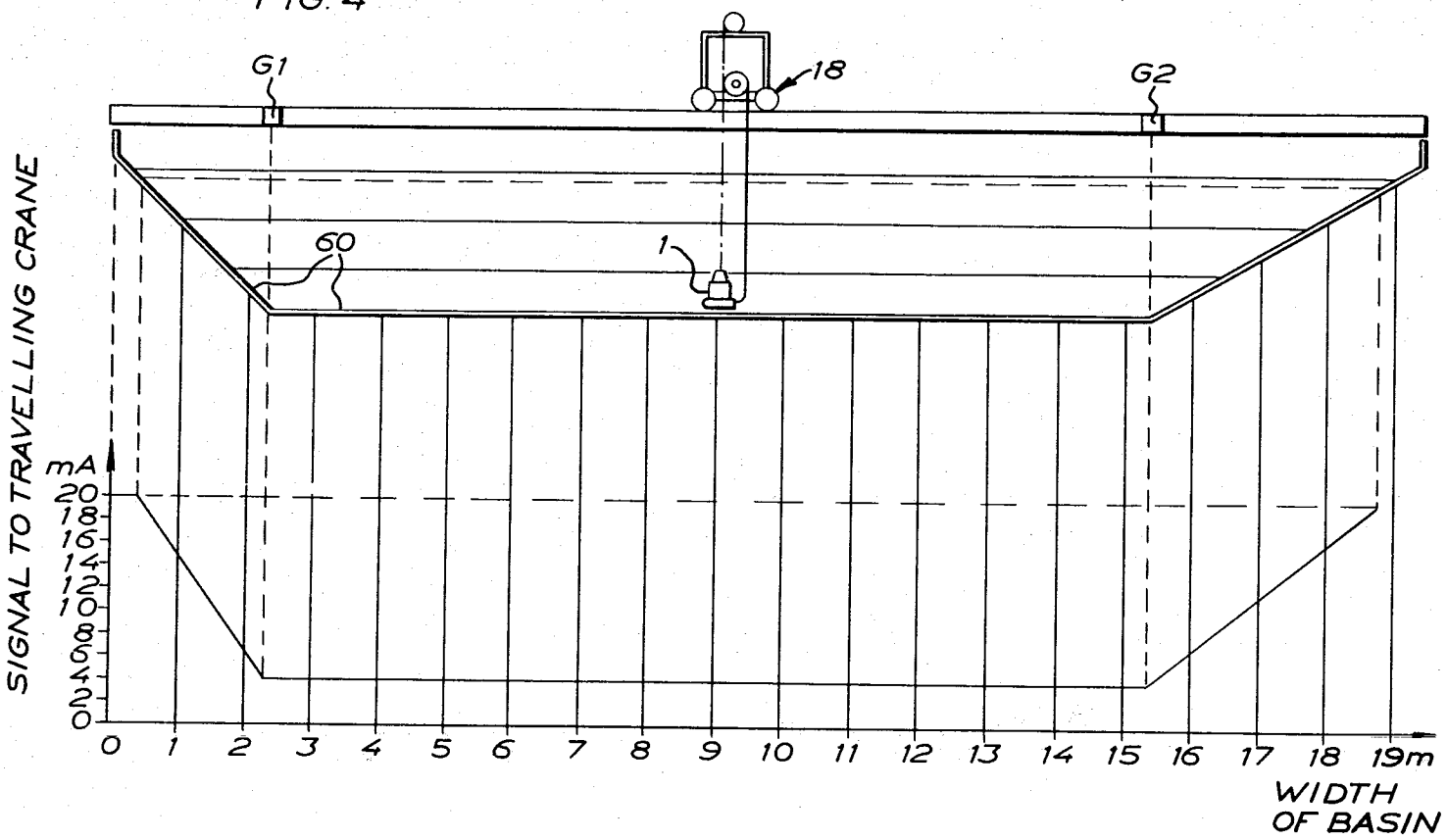
FIG. 4 is a schematic longitudinal section of a sedimentation basin with limit switches for the bridge trolley in FIG. 1, and shows a velocity control diagram.

Limit switches can be placed at selected positions, such as G1 and G2 in FIG. 4, along the basin for changing over between the currents $I_1$ and $I_2$, whereby the velocity curve illustrated in FIG. 3 can be obtained for opposite directions of travel. This method can be used to advantage, for example when sludge of low sludge concentration (thin sludge) is pumped and when it is desired for the bridge trolley to be moved at different constant or varying velocities, e.g. to give the hoisting device time to follow a predetermined basin bottom contour 60 (FIG. 4) or oblique basin side walls.

Before the bridge trolley reverses its direction of travel it is suitable for instance to reduce its velocity in the manner that appears from the right part of the curve in the diagram of FIG. 3.

Instead of regulating the velocity by means of current $I_x$, this current can be used for regulating the height position of the suction assembly 1 to permit effectively sucking sludge in basins with inclining bottom 60, or to control the control valve 8 in the conduit 5 in order to regulate the flow rate in this manner.

As is well-known, the true profile of a sediment bed in a sedimentation basin shapes itself after the composition of the sediment, and since the composition of the sediment can vary, the shape of the profile can also vary. Another variable is the sludge concentration which varies in dependence on the type of the sludge and the settling time thereof. The invention allows an automatic control in dependence on all of these factors.

In the above description it has been assumed that the flow rate is measured with the aid of a pronounced flow meter. With pure water the pump pumps a maximum volume of Q $m^3$/min. If the control system is set according to the above description for a normal flow rate of 90% of Q and for transmission of restoring signals on either side of said value the control system then tends to maintain this value, which can be realized by raising or lowering the suction assembly 1 for maintaining the value 90% of Q, that is, the pump continuously operates for transporting sediment in the concentration which corresponds to 90% of Q.

The depth of the sludge profile can heavily vary in the longitudinal direction of a sedimentation basin. In some parts of the basin there may be thin sludge layers with low sludge concentration. Since sediments in a sedimentation basin have a definite settling time it must be possible to suck clean also thin layers. In these areas the automatic sludge sucking system operates as follows.

Instead of the flow meter 7 use can be made of a solids concentration sensor with a signal transducer, say a so-called TS-content meter (dry solids content meter) of the type offered for sale by EUR-control Sverige Försäljnings AB at Säffle, Sweden. Such a solids concentration sensor or TS-content meter can sense the sludge concentration and deliver an electric signal proportional to said concentration.

Some Examples of the control that may be carried out with the aid of the control equipment illustrated in the drawings, shall now be given.

EXAMPLE 1

It is assumed that a sedimentation basin has a sludge profile that can be divided into three areas A, B and C of different sediment depth.

The sludge concentration is highest in area A, and the sensor 7 which is here assumed to be a solids concentration sensor operates within a preset upper load range of a certain given signal strength above a normal range corresponding to the load of the sensor in area B, where the concentration is on an average lower, while the concentration in area C is on an average lowest and the signal strength lies below the normal range.

In area A pumping takes place with full flow rate. The flow through the sensor 7 is maintained at preset concentration by raising and lowering the suction assembly 1 and moving it stepwise in horizontal direction, e.g. according to the control pattern described in U.S. Pat. No. 4,037,335.

When the sludge concentration decreases the sensor 7 passes on to working at the sludge depth prevailing in area B and then to working at the sludge depth corresponding to area C.

As already mentioned, the concentration in area B is higher than that in area C or at most equal to the preset value (moderate depth of sediment). Sucking takes place at full flow rate. The preset concentration is maintained by increasing and reducing the velocity of travel of the bridge trolley.

When the velocity of travel of the bridge trolley has reached its maximum and the concentration cannot be maintained, there occurs a transition to area C, and when the velocity of travel of the bridge trolley has reached its minimum and the concentration still cannot be maintained, there occurs a return to area A. The plant thus operates in dependence on the sludge profile and leaves no part of the sludge bed untouched and at rest, where the sludge is allowed to remain for a longer time.

When work is done in area C where the sediment layer is of insignificant depth, the preset concentration is maintained by reduction of the flow rate with the aid of valve 8 in FIG. 1. The flow rate continues to decrease to a predetermined minimum flow rate in order that at least some flow shall be maintained even where very small amounts of sediment occur.

EXAMPLE 2

Figure 6:
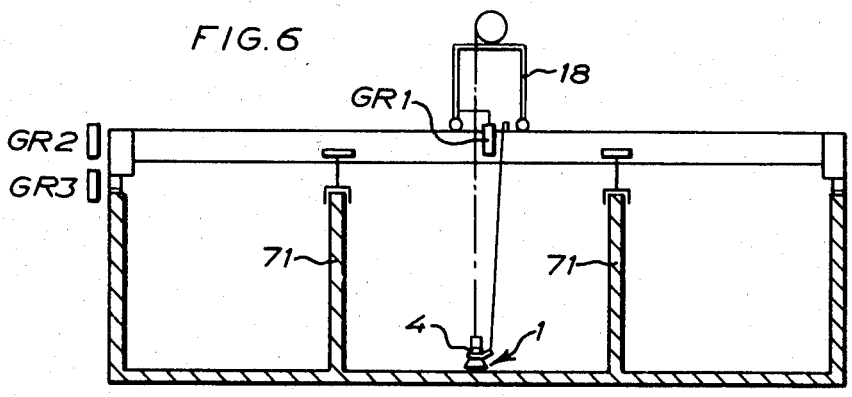
FIGS. 5 and 6 are respectively a schematic plan view and a vertical section of a basin having fixed limit switches for the bridge trolley.
Figure 5:
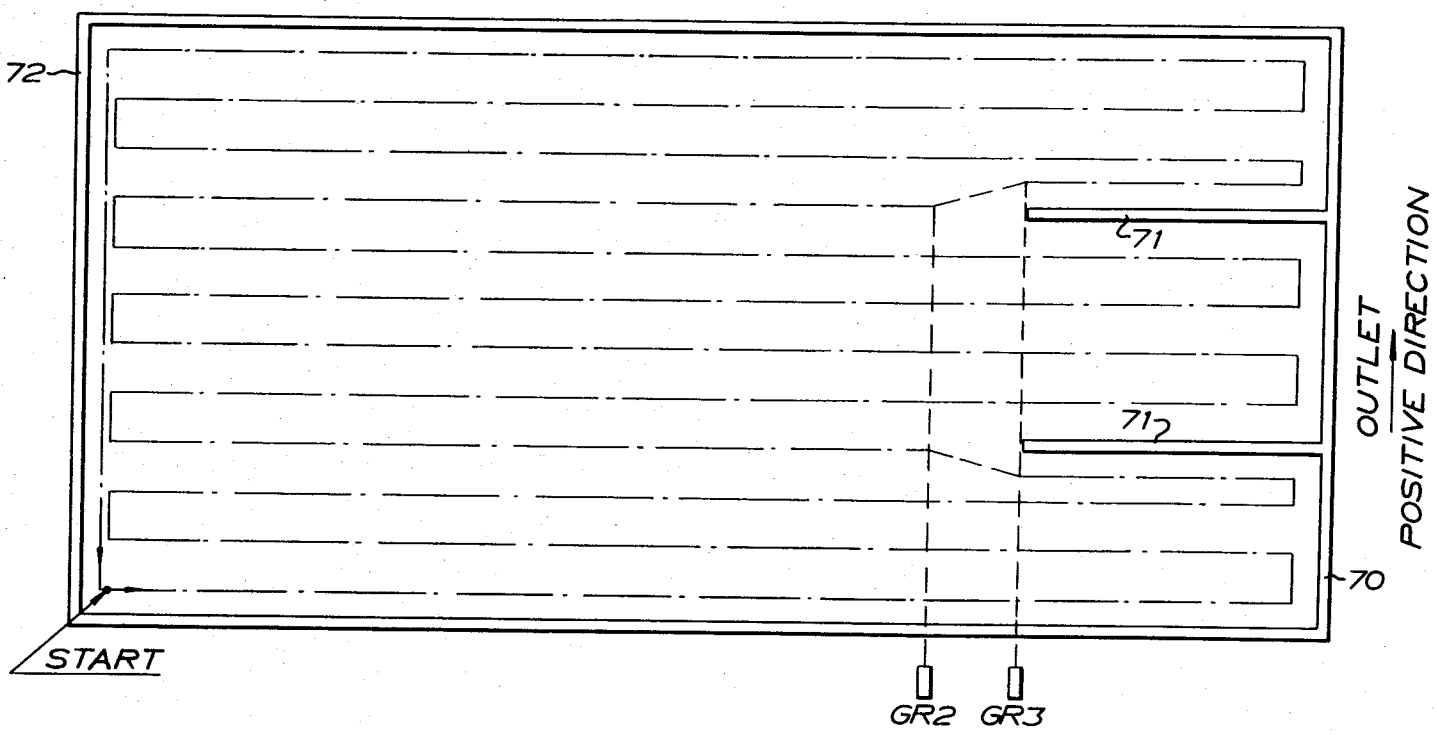

This Example concerns the movement of the bridge trolley in conjunction with a basin; reference is made to FIGS. 5 and 6.

The pump 4 begins to operate in the position "Start" and is moved by the bridge trolley towards the outlet side 70 of the basin.

A limit transducer (limit switch) GR1 is actuated by a metal plate of the same length as the width of the baffles 71, placed on the bridge trolley opposite said baffles.

When the bridge trolley is moving towards the outlet side 70 of the basin and passes a second limit transducer GR2 at the same time as the limit transducer GR1 is actuated, the pump performs a lateral movement in "positive" direction until the limit transducer GR1 is no longer actuated. If this lateral movement has not taken place, when the assembly 1 has almost reached the baffle, a limit transducer GR3 emergency stops the bridge trolley and gives the signal "Alarm". The remaining part of the lateral movement takes place when the bridge trolley reverses its movement and travels towards the inlet of the basin.

If GR1 and GR3 are actuated simultaneously, when the bridge trolley is moving towards the inlet side 72 of the basin, the remaining part of the lateral movement which would have been performed if GR1 had not been actuated, when the movement of the bridge trolley is reversed at the basin outlet. After concluded operating cycle the pump goes to the "Start" position and stops, provided the number of operating cycles set on a selector counter (not shown) have been performed.

If the basin has sloping longitudinal walls, the assembly 1 can be steered in such a way that the lowermost position of the nozzle follows the slope of the wall (or the slope desired).

Otherwise, the automatic sludge sucking system operates along the sloping basin walls in the same manner as in the remaining basin, i.e. the pump is controlled by the height and concentration of the sludge.

It will be realized from the foregoing that the control system according to the invention permits several possibilities of combination and can be supplemented with diverse switching and time functions, whereby a great many program variations can be attained. As a result, the invention provides a system of great versatility and permits full automation with remote supervision.

The signal pulses of the control system are preferably current signals of the order mA and it is possible to supervise the functions of the plant on equipment remote from the plant for registration, display and remote control.

In a modification illustrated in FIG. 1 by broken lines, the control valve 8 can be dispensed with, and flow rate control can instead be performed by control of the rpm of the pump motor. In this modification the signal output of the flow rate or solids concentration sensor 7 can be connected, by actuation of the limit current sensor 9 and the switch 10, to a frequency converter 80 (instead of the control valve 8 dispensed with) and via said converter to the motor of the pump 4 for control of the pumped flow. Thus, no throttling need take place in the conduit 5 to the receiver 6, and any risk of clogging is avoided.

For automatic cleaning of the conduit means 5, the sensor 7 and the valve 8 (if such a valve is used) the system can include a water pump connected to the conduit 5 after the sensor 7. If a valve 8 is used, said valve can be closed and the water pump started for pumping of clean water through the conduit 5 and discharging it through the nozzle 3. If control of the pump motor 4 is substituted for the control valve 8, a shut-off valve can be provided in lieu of the valve 8 and the water pump can be connected to the outlet of the sensor 7. Said cleaning device can be controlled by means of the sensor 7 via the regulator 13 or the switching arrangement 9, 10 and no showing thereof will be required on the accompanying drawings, since the construction of said device will be readily understood from the above description.

After one or a few rapid flushing operations have been performed an alarm apparatus (not shown) in the control circuit can be activated if the cleaning operation does not result in clean flushing, so that normal operation is automatically re-established.

It should be noted that a hydraulically operated pump can be utilized instead of an electrically operated pump 4.

The control system according to the invention is an effective aid in controlling suction plants for continuous cleaning of sedimentation basins, so-called sludge basins, and permits utilizing basins of simpler construction than that hitherto used. For instance, use can be made of basins with solid gravel bottoms, asphalted bottoms, bottoms covered with rubber cloth, concrete bottoms etc. Since the suction assembly 1 need not have contact with the bottom surface by scrapers or like means, but can operate with the suction nozzle some centimeters above the bottom, the solid basin bottom can be selected according to quite other considerations than for instance the question whether or not the sludge shall be reused, and quite independently of natural ground conditions.

The control system described can also be used in plants for taking up sediments from lakes and water courses, in which case the supporting mobile device may be in the form of a raft, barge, lighter, ship or the like. The system can also be used on land for sucking material suspendible for instance in air.

Therefore, the invention is not restricted to installations for sucking sludge from sedimentation basins but can be used wherever it is desired to control the movement of a suction and pumping assembly along three relatively perpendicular axes.

In one embodiment the control system may be so arranged as to automatically increase the speed of the pump when the pump is raised at the command of the inclination sensor. Such a system may be utilized in such a manner that the pump when working close to the bottom, that is, at insignificant sludge depth, operates only at a low, economically optimal effect. If the sludge depth increases at some point and the pump with the nozzle as a consequence receives a raising command and is raised, the speed of the pump should then be increased for effective sludge sucking, where the sludge layer is of greater thickness. Normally, it is sufficient to have the pump operate at two different speeds dependent upon the sludge depth (the thickness of the sludge bed), such as an economical speed when the nozzle is being moved over an insignificant sludge depth, and a maximum speed when the nozzle is being moved over a sludge bed of greater depth (thickness).

It should further be observed that the pump need not necessarily be driven by an electric motor. Hydraulically or pneumatically operated pump motors are also usable, and in certain cases part of the control system may be of pneumatic or hydraulic type.

What I claim and desire to secure by Letters Patent is:

1. Method of controlling a device for sucking a material suspendible in air or liquid having a suction nozzle connected to a pump through a conduit by means of a sensor connected to said conduit, the suction nozzle being supported via a flexible supporting means by a hoisting device which is carried by said device for moving the hoisting device and the nozzle along at least one horizontal axis at adjustable velocity, while the nozzle is vertically adjustably carried by the hoisting device, wherein the hoisting device for vertically adjusting the nozzle is controlled by means of a control device by signals from the sensor in such a way that said sensor is preset to supply a control signal to the hoisting device for raising or lowering the nozzle to thereby restore the quantity per unit time in the conduit when the quantity per unit time exceeds or falls below a predetermined value which lies below a maximum value, and wherein the control device to which the sensor is connected, is adapted, when the quantity per unit time exceeds or falls below a certain upper and lower threshold level therefor as a function of time and working depth of the nozzle, to send the control signal from the sensor to control the quantity per unit time within definite limits the steps comprising: determining a maximum quantity by running the pump and nozzle in air or liquid which is free of the suspended material, assigning a limit range for the sensor that is less than the maximum quantity, selecting a time interval for a time relay within which deviations from the limit range of the sensor will not alter control of the device but in excess thereof will alter control, switching the control circuit from control of the working depth of the nozzle by regulating the hoisting device to control the pump rate of the control valve depending on signal strength, time and certain nozzle depth sensed, moving the hoisting device and the nozzle with regard to the quantity sensed, which is pumped through the conduit, moving the hoisting device in dependence on the inclination of the flexible supporting means at definite limits of inclination angle and in combination with time, controlling the quantity in dependence on signals supplied by a device for sensing the weight load carried by the movable supporting means or the tension of said means.

2. Method as claimed in claim 1, including raising and lowering of the pump by actuating the hoisting device depending on the inclination of the flexible supporting means to the vertical as a function of time.

3. Method as claimed in any of the preceding claims, including moving the hoisting device and the nozzle both with regard to start and stop and with regard to velocity by control signals from a device for sensing the height position or working depth of the nozzle.

4. Method as claimed in claim 1 including moving the velocity of the hoisting device in dependence on the position of said device in a definite path of movement.

5. Method as claimed in claim 4 including sensing the inclination of the flexible supporting means inclination sensor and controlling the rpm of a pump motor in dependence on the wire rope inclination.

* * * * *